United States Patent [19]

Obermüller

[11] Patent Number: 4,820,500

[45] Date of Patent: Apr. 11, 1989

[54] PROCESS FOR CONTROLLED AFTERBURNING OF A PROCESS EXHAUST GAS CONTAINING OXIDIZABLE SUBSTANCES

[75] Inventor: Herbert J. Obermüller, Linsengericht-Grossenhausen, Fed. Rep. of Germany

[73] Assignee: Katec Betz GmbH & Co., Hasselroth, Fed. Rep. of Germany

[21] Appl. No.: 14,030

[22] Filed: Feb. 12, 1987

[30] Foreign Application Priority Data

Feb. 20, 1986 [DE] Fed. Rep. of Germany ..... 3605415

[51] Int. Cl.[4] ..... B01D 53/34

[52] U.S. Cl. ..... 423/210; 110/207; 110/210; 110/214; 423/245.1; 431/5; 431/11

[58] Field of Search ..... 423/210, 245; 431/11, 431/5; 110/207, 210, 214

[56] References Cited

U.S. PATENT DOCUMENTS

| | | | |
|---|---|---|---|
| 3,754,869 | 8/1973 | Van Raden | 110/210 |
| 3,827,867 | 8/1974 | Zenkner | 423/210 |
| 4,199,549 | 4/1980 | Wilt, Jr. et al. | 423/210 |

FOREIGN PATENT DOCUMENTS

| | | | |
|---|---|---|---|
| 2452418 | 8/1975 | Fed. Rep. of Germany | 110/210 |
| 2556446 | 6/1985 | France | 423/210 |
| 149633 | 11/1980 | Japan | 423/210 |

OTHER PUBLICATIONS

"Saving Fuel with Catalytic Heat Recovery," Ruff, Industrial Gas, Oct., 1955, pp. 6–9.

*Primary Examiner*—John Doll
*Assistant Examiner*—Jeffrey E. Russel
*Attorney, Agent, or Firm*—Dennison, Meserole, Pollack & Scheiner

[57] ABSTRACT

A process and an apparatus for the thermal incineration of oxidizable substances in a process gas are proposed, whereby the process gas is conveyed through an afterburning apparatus 10 comprising, inter alia, a combustion chamber 18 and a process gas outlet 24 in order to remove purified exhaust gas from the process gas outlet 24, and to mix said purified gas in with the process gas in order to maintain a constant concentration of the process gas.

10 Claims, 3 Drawing Sheets

PROCESS FOR CONTROLLED AFTERBURNING OF A PROCESS EXHAUST GAS CONTAINING OXIDIZABLE SUBSTANCES

The invention refers to a process for controlled afterburning of process waste gas which contains oxidisable substances, where the gas is fed through an afterburner apparatus. In this apparatus, the said gas is fed through a gas inlet and a heat exchanger to the burner and the combustion chamber, from which it is then fed, in its now purified state, through the heat exchanger to a gas outlet; the invention also refers to an apparatus for the execution of this process.

Equipment for the afterburning of oxidisable substances in a process waste gas such as hydro-carbons is set forth in the EP-B1-0 040 690. Here, the process waste gas, having been preheated in heat exchanger tubes, is fed into burner whose heat release is adjusted according to the varying quantity of oxidisable substances and to the fluctuating supply of waste gas flow at any given time. The U.S. Pat. No. 2,905,523 shows a process of treating exhaust gases which serves the catalytic combustion of soot and combustible dusts together with gaseous substances. In order to increase the temperature of process gas which is too cold, this process recycles part of the incinerated hot gas and mixes it in with the cold gas in substitution for the otherwise customary recuperative heat exchange and also serves the recycling start-up of the system. This recycling thus ensures the ignition level, i.e. the maintenance of the minimum bed temperature in the catalyst. In addition to this, the process allows air to be fed into a main stream and into a bypass stream of the unpurified exhaust gas in order to increase the oxygen content, should it be too low, or for the purpose of rarefication should the combustible substance content be too high. The latter serves to protect the catalyst, which should not be heated above 1600° F. Both functions, the recycling of hot exhaust gas and the infeed of air are completely separate functions in terms of technological procedure, and each fulfils a different purpose. Thus, the recycling of hot air serves solely to maintain the process. In the case or recuperative pre-heating of the process gas, recycling does not occur. Where the infeed of air serves solely the purpose of rarefaction and not that of adding oxygen, it only fulfils the purpose of protecting the catalyst from overheating. By means of the U.S. Pat. No. 2,905,523 a process is described in which the combustion chamber, together with catalyst and downstream elements may operate within a temperature range of between 570° F. and 1600° F. (573 K to 1143 K), without influencing the incineration.

It would be desirable to maintain as constant a temperature as possible, as rapid changes in temperature would otherwise cause too great a strain on the material and, consequently fatique.

It is common practice in thermal afterburning, when operating with minimum fuel consumption, to allow the temperature of the combustion chamber to fluctuate within a "tolerance range" up to a value which is barely below the prescribed safety shutdown limit until the temperature peaks caused by process changes have fallen again. Occasionally, however, the peaks are so high that the shutdown temperature is reached and normal operation has to be interrupted. This is then known as over-temperature shutdown. Both the over-temperatures and the said interruptions have a detrimental effect on the durability of parts subject to more wear and tear. In view of current requirements linking production and exhaust gas purification, this usually leads automatically to the interruption of the production process and, subsequently, to high loss of production.

Added to this is the fact that, in technical application, temperature gauges such as thermocouples are placed in protective sleeves with the result that there is a delay, a reduction or a failure in registering temperature peaks. This is another factor which does not contribute to the longer service life of incineration appliances.

Smaller fluctuations in volume flow which may occur as an inherent factor in the process generally have a detrimental effect on the combustion chamber temperature. The effects of these fluctuations are comparable to those which result from a fluctuating intake of oxidisable substances.

The above-mentioned temperature fluctuations are inevitable in current technology if an incineration appliance is operated to the limit of its thermal capacity and its capacity to process impurities, unless measures are taken to eliminate excess energy.

If, however, the heat intake into the system increases at a distinctly faster rate than the burner of the afterburner appliance can throttle back on its own heat generation, then the compulsory shutdown of the plant (by activating the over-temperature switch) is absolutely imperative, unless the plant is equipped with a secondary system for the reduction of the total heat quantity introduced into the combustion chamber.

In this context, "total heat quantity" refers to the enthalpy of the process gas requiring treatment, including the heat quantities introduced by oxidisable substances and produced by the burner when operating at control range minimum. As currently high energy costs dictate extensive preheating of the process exhaust air, the enthalpy of the preheated air in the heat exchanger is thus the limiting size factor.

As already mentioned, this is determined by extensive preheating, but also by the temperature of the exhaust air extracted from the production process. As the temperature of the exhaust air from the production process increases, so too, does the preheating temperature increase, with the result that the overall capacity to process combustible substances diminishes.

In terms of the overall design capacity, this loss of capacity due to the increased exhaust gas temperature can be considerable, particularly if the appliance is operated at low gas flow, as the minimum heat release of the burner (which is a constant value) then consumes a large proportion of the capacity for oxidisable substances.

Therefore, in order to reduce the extent to which the exhaust air is preheated, conventional technology calls upon the "bypass technique", i.e. using the principle of the single-sided or double-sided bypass to redirect a portion of the main exhaust air stream past the mainly recuperative heat exchanger.

This partial redirecting of the flow past the heat exchanger requires integrated or externally situated ducts or pipework, control and thermally suited valve and damper technology, thermal compensation elements and suitable mixing techniques for remixing the diverted air flow with the main flow after it has passed through and around the heat exchanger. Moreover, there is an increased need for insulation.

Where single-sided bypassing (hot side or cold side) is concerned, it is invariably an inherent property of the bypass technique that, due to the operation of the bypass, the mass of the heat exchanger always has to find a new level of thermal equilibrium. In other words, the mass temperature of the heat exchanger is continuously adjusted. If a heat exchanger is bypassed on the hot gas side, this consequently means that the change in preheat temperature can be achieved solely by changing the thermal equilibrium of the total mass of the heat exchanger—i.e. only by means of a very slowly responding process. The latter is thus unsuitable as an instantaneous control device and is therefore less commonly found. If only the cold gas side is bypassed, then, although the regulating rate may be considered as instantaneous, the more the volumetric flow diminishes in the heat exchanger, the more the reduced air volume is preheated; the larger the bypass take-off, the greater the preheat. This property leads, inter alia, to extreme precombustion of the combustible substances in the heat exchanger. It thus makes the heat exchanger, which is not generally suited to such a function, into a precombustion chamber, with all the concomitant negative effects.

Added to this is the overall increase in the temperature level of the exchanger, which, due to the generally large mass involved, is slow to recede.

Although the cold bypass constitutes the only feasible solution to the single-sided bypassing of the heat exchanger, it nevertheless entails further major limitations and negative consequences: it necessitates thorough mixing of the cold, not preheated, bypass volume flow in and with the very hot, preheated air. This necessitates rises on grounds of the fact that temperature differences of 15° K. in the combustion chamber cross sectional areas of flow can mean insufficient combustion and high CO levels. This results in the need to increase the combustion chamber temperature likewise by 15° K.

At the high temperature levels at which modern plants operate with low burner minimum duty and very high final purity requirements, a further 15° K. can constitute a considerable technological obligation.

The high standards required of combustion while preventing higher CO and $NO_x$ levels necessitate good mixing and combustion chamber technology. The call for immediate adaptation of incineration technology to meet the demands of everfaster and more rapidly reacting production processes, and to meet safety requirements as well as the demand for extensive availability and high durability often approve only those energy control systems in current technology which consist of double-sided bypassing of the heat exchanger. In comparison to single-sided (cold) bypassing, the double-sided bypassing systems also even out considerably larger differences in concentrations of oxidising substances. Therefore, where greater capacity fluctuations are concerned and where higher demands are made in respect of the quality of process technology, double-sided bypasses are frequently the only ones that come into question for standard technology. This applies, in particular, where the combustible substance has a low ignition temperature, e.g. in the case of mineral oils and benzines.

The additional increase in the temperature of the heat exchanger which results solely from a cold bypass could have inadmissable consequences for the generation of CO by the heat exchanger and also intolerable results for the steels, as it is common knowledge that CO is a carbon carrier which can lead to embrittlement of steels in the higher temperature range as well as to rapid descaling.

High CO generation should be avoided as far as possible. High CO production, however, goes virtually hand in hand with the bypass technique: the higher the concentration of the combustible substances, the longer the dwell time in the heat exchanger, and, consequently, the greater the CO generation. The bypass operation is thus a further amplifier of this interrelationship.

As a rule, bypass techniques are technologically complex, expensive and require a high degree of control and supervision. In the case of double-sided bypassing of the heat exchanger, the volumetric flows must be as equal as possible at each moment of control and the control devices must always be in parallel operation.

The bypass systems are also complex with regard to construction, detail technology, assembly and starting-up. Whilst in operation, they require a considerable degree of maintenance.

The object of the invention presented is to develop a process such as the one described in such a manner that fluctuations in the concentration of oxidisable substances suspended in the process exhaust gas and an increase exceeding the specific capacity for oxidisable substances do not result in the consequences described above. In other words, inter alia, the combustion chamber temperature need not be increased as a result of inadequate mixing, temperature peaks reaching the shutdown limit can be avoided, high-temperature shutdowns become a virtual impossibility, increased availability of the combustion system as an integral part of the overall technical system liked to the production process can be achieved, the bypass systems with all their problems and their consequent direct and indirect costs can be avoided, a higher increase in the concentration of impurities than that which could be expected of a single-sided bypass system can always be coped with, expensive mixing techniques become unnecessary, no additional equipment need be installed on or in the afterburning appliance, and the insulation and thermal compensation thereof may be omitted.

As far as the process involved is concerned, this objective is achieved pursuant to the invention by adding in a mixture of purified process exhaust gas and fresh air to the process exhaust gas which is to be fed into the afterburner in the desired quantity in such a manner as to maintain the concentration of oxidisable substances of the gas mixture at an adjustable level. In other words, when the concentration of combustible substance increases, purified process exhaust gas together with fresh air will be added the moment the burner has reached its control range minimum (its basic duty) and will be added in to a controlled extent and in increasing quantity as the concentration of combustible substances increases. Such addition is always made to precisely the amount required in order to maintain the temperature in the combustion chamber in accordance with its nominal desired value. The burner itself remains at control range minimum during this process and no longer intervenes in the process. Establishing the mixed air temperature is subject to a second control cycle which determines whether more or less warm purified exhaust gas or cold fresh air is to be added. The quantity for this control task is the given difference between the actual temperature of the exhaust gas and the desired nominal temperature. In other words, the input temperature of the mixture consisting of untreated process exhaust gas, purified exhaust gas and fresh air to be fed into the afterburning appliance is maintained at an adjustable level. Further pursuant to the invention, it is proposed that an appropriate quantity of mixed air, consisting of more or less purified exhaust air and less or more fresh air, be added to the process gas which has too high a concentration of combustible substance, prior to its infeed into the afterburning appliance, and that this input of mixed air be made at precisely the quantity required in order to maintain, by means of a rarefaction operation, a constant combustion chamber temperature at burner control minimum. In other words, while the burner is constantly operating at its minimum, the combustion chamber temperature is thus kept constantly controlled and, at the same time, the concentration of the combustible substance in the exhaust gas is virtually constant.

This results in advantages which, inter alia, manifest themselves as follows: the burner temperature is always controlled to the nominal desired level, which it cannot exceed under the same conditions; the heat exchanger always maintains the same temperature level, irrespective of the concentration of impurities and the degree of excess energy control; the dwell time, in the heat exchanger, of the medium to be heated decreases rather than increases as the excess energy control increases; the generation of CO drops rather than rises; the preheating temperature remains constant rather than fluctuates; the heat exchanger tends less rather than increasingly to act as a precombustion zone; the temperature equilibria remain constant; the technique entails further advantages, such as constant idling operation or warm standby, less expensive start-up of the entire system, shorter start-up time for the entire system, increased durability of the equipment by eliminating virtually all high temperature peaks and upper temperature oscillations, reduction of carbon diffusion into the steels by reduction of the CO level and, consequently, longer maintenance of the properties of the steels, avoidance of cyclic shocks caused by switching from process air to cold air, extremely rapid response to procedural changes, such as (or even faster than) those of which the burner is capable, a lower CO level due to less auto-generation, a lower $NO_x$ level due to avoidance of a high combustion chamber temperature as well as control response to excessive exhaust temperature when the concentration of combustible substances is already too high for the burner control anyway.

Pursuant to the invention, the concentration of oxidisable substances is always adjusted once the burner minimum is reached in such a manner that the quantity of heat released by the burning of oxidisable substances maintains the combustion chamber temperature at precisely its desired nominal level, i.e. does not allow it to fall or to increase.

The following property is also related to the solution offered by the invention: the constant outlet temperature of the purified and recooled exhaust gas released from the afterburning appliance. Whereas conventional bypass systems cause fluctuations of up to 150° K. (=270° F.), the process control offered by the invention operates at an almost constant temperature. This constant temperature not only has the above-mentioned positive effects on the unit itself, but also on all subsequent equipment: all subsequent equipment is to be designed and manufactured solely for the low standard temperature level. This applies to all equipment, even including the stack.

An essential, future-oriented property of this system is its risk-free suitability for the safe implementation of heat exchangers which preheat to extremely high temperatures. Where conventional units equipped with bypasses are stretched to the limits of their preheating capacities due to the CO problem (a maximum of 550° C., 1022° F., is mentioned and indeed quoted in literature), the system proposed by the invention is far from reaching its limit: preheating can be carried out up to 650° C., 1202° F., and this, as mentioned above, is with virtually no fluctuation.

The criterion for mixing air with the untreated process gas is then the excess of combustible substances above the maximum possible capacity at burner control minimum.

A further parameter determines the mixture of more or less warm and cold air to be added to the system: the level of the process air temperature. If this temperature is also above the nominal value and if mixed air is required, then fresh air is added first, followed by warm air once the nominal temperature is reached.

However, if the temperature is unacceptably low, then initially, only warm air is added as required. In other words, the system retains the normal temperature level at all times and at all places, (a) for the medium, (b) for the appliance. Bypass units, by comparison, are subject to enormous fluctuations. The system invented therefore eliminates cyclic strain on the components. Everything is warm and remains warm or it is hot and remains hot. Operation approaches and achieves the ideal operating mode, namely the completely constant operation of all components over a long period of time.

On the other hand, some of the properties specified above are also achieved because, when the process air flow stops (process-related and malfunction-related safety shutdown), a small quantity of mixed warm air adjusted to the normal process air temperature continues the operation most economically, whereby the complete evenness of all temperature levels of the normal process operation is maintained at each individual part of the plant, ensuring its readiness to continue the operation later with process gas.

The distinguishing feature of a unit for controlled afterburning of oxidisable substances suspended in a process exhaust gas comprising a process exhaust gas input, a heat exchanger with the tube bundle placed, preferably, concentrically around the combustion chamber, a burner with a, preferably, high-velocity mixing chamber connected, a main combustion chamber and a process exhaust gas outlet is that it provides a connection between the unit and the process exhaust gas inlet through which a controlled quantity of purified exhaust gas may be refluxed, mixed with air, into the main stream. This connection runs, preferably, between the process exhaust gas outlet and the inlet. By means of simple design methods which need neither operate inside the unit nor require installation of butterfly valve type mechanisms, it is possible for the required amount of purified process exhaust gas and/or air to be added to the untreated process exhaust gas in order to maintain the proportion of oxidisable substances at a constant level and correct the temperature of the process gas.

Thus, incineration units can be constructed in such a way that a connection is provided between the process exhaust gas outlet and the process exhaust gas inlet which enables more or less fresh air to be mixed with the purified exhaust gas in the desired quantities to be circulated or refluxed back.

Mixed air produced in this manner is added to the process exhaust gas downstream of the suction side of the process exhaust gas fan.

Warm air is refluxed externally using simple design methods. The dosage of both warm air and cold air is regulated by an independent control isolating device i.e. dampers or valves.

The quantity of warm or cold air, respectively, is determined by a temperature controller which monitors the temperature of the process gas-air mixture being conveyed to the afterburner appliances.

The overall quantity of air required is determined by the temperature controller which is responsible for the constant combustion chamber temperature.

Further details, advantages and properties of the invention arise not only from the claims and from the characteristics set forth therein, be it individually and/or in combination, but also from the following description of one of the preferred examples of application as illustrated in the drawing:

Figure 1:
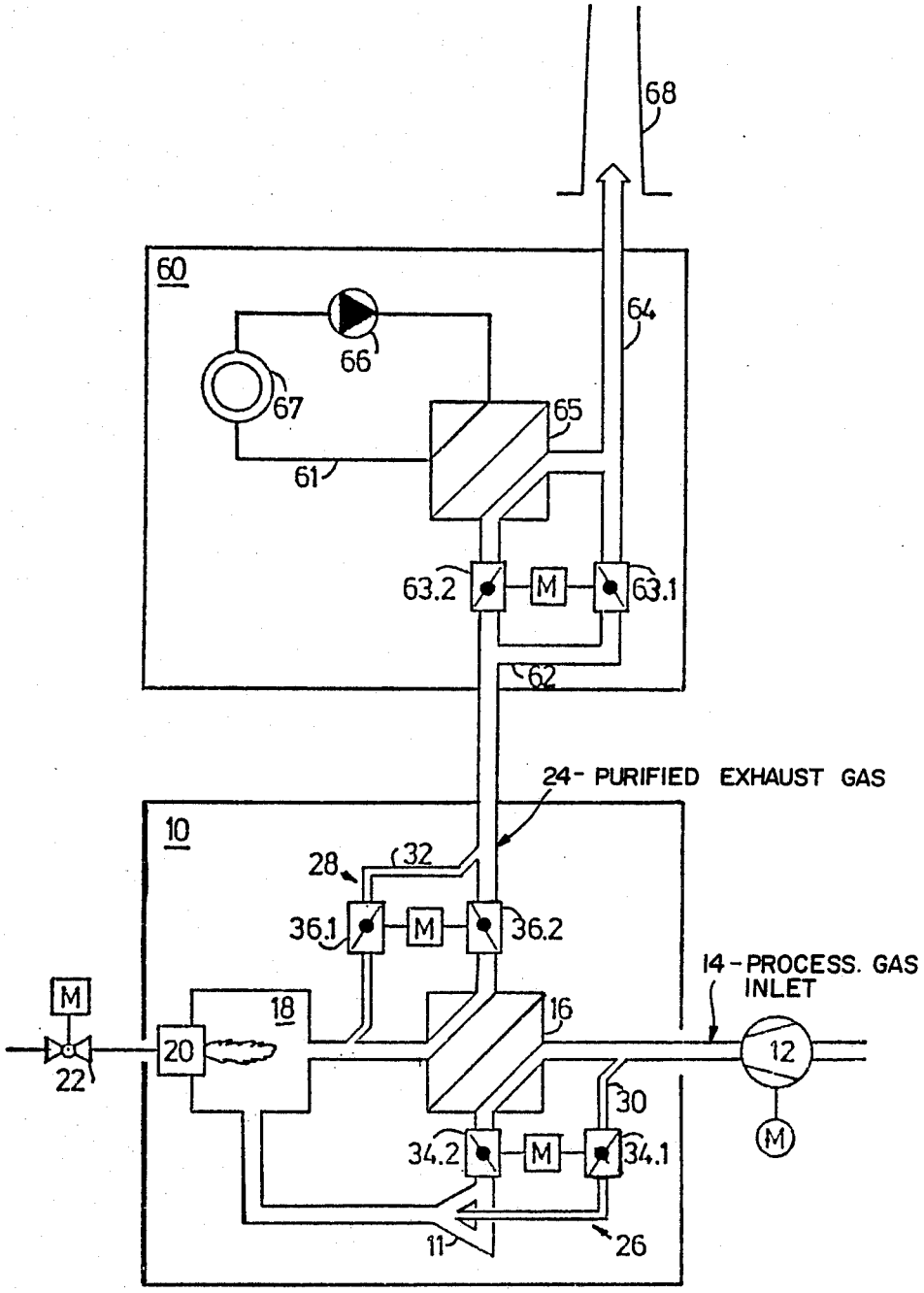
FIG. 1 PRIOR ART
FIG. 1 shows the principle of an after burning method of process exhaust gas containing oxidisable substances with bypasses for the purpose of energy control.

FIG. 1 is intended to elucidate a conventional excess energy control, whereby the essential elements of the afterburner appliance (10) are shown purely schematically. The untreated process gas is conveyed to the afterburner via an extraction fan (12) and the process gas inlet (14). The untreated process gas then flows through a heat exchanger (16) into a combustible chamber (18) in which the oxidisable substances are to be incinerated, given that these have not already been partially incinerated in the heat exchanger unit. The combustion chamber (18) may be reached, via a high-velocity pipe not shown on the diagram, starting from a burner (20) whose fuel intake can be regulated via a control valve (22). The purified exhaust gas from the combustion chamber (18) is redirected via the heat exchanger (16) in order to preheat the untreated process gas by means of heat recovery.

The purified exhaust gas is then expelled via a duct (24). In case of extensive fluctuations in the process gas with regard to the concentration of substances to be oxidised occurring in the duct (14), bypasses (26) and (28) are provided to counteract the temperature increase in the combustion chamber (18). This is achieved by partially bypassing the heat exchanger (16), thus reducing the preheating level as far as is required by the increase (fluctuation) in the concentration of combustible substances. During this, the burner (20) operates at its control minimum for as long as the excess intake of combustible substances continues.

In this process, bypass (26) is designed as a connection for cold gases, and bypass (28) is designed for hot gases. Each bypass, both (26) and (28), has a circular duct (30) or (32) in or around the appliance (10) fitted with control mechanisms such as valves (34.1) or (36.1) in order to modulate the bypass to the required extent or shut down its operation. The bypass (26) forms a connection between the cold process gas flowing in the duct (14) and the burner chamber (in the diagram, the duct opens into the combustion chamber (18). The bypass (28) forms a connection between the combustion chamber (18) and the exhaust gas outlet (24). As a bypass can only increase its flow volume as long as the residual quantity flowing in the heat exchanger experiences a larger resistance to flow than the quantity flowing in the bypass, the control capacity is soon exhausted unless a second control device throttles back the main stream and thus continuously increases the amount conveyed by the bypass. These devices are numbered (34.2) and (36.2).

The equipment installed downstream of the appliance (10) for utilisation of residual heat contained in the purified exhaust air is shown in FIG. 1 in the form of a warm water/air heat exchanger. The equipment comprises a heat exchanger (65), the bypass control device in the form of butterfly valves (63.1) and (63.2) for increasing or reducing the heat which is to be exchanged, the bypass duct (62) and the reuniting duct (64) as well as the closed cycle water system (61) with its consumers (67) and its feed pump (66).

On leaving the heat exchanger (65) or on partially or completely bypassing the same, the now further cooled exhaust air flows towards the stack (68).

All elements of the appliance (10), including the exhaust gas duct (24) must be designed to withstand the maximum temperature which can be produced.

Figure 2:
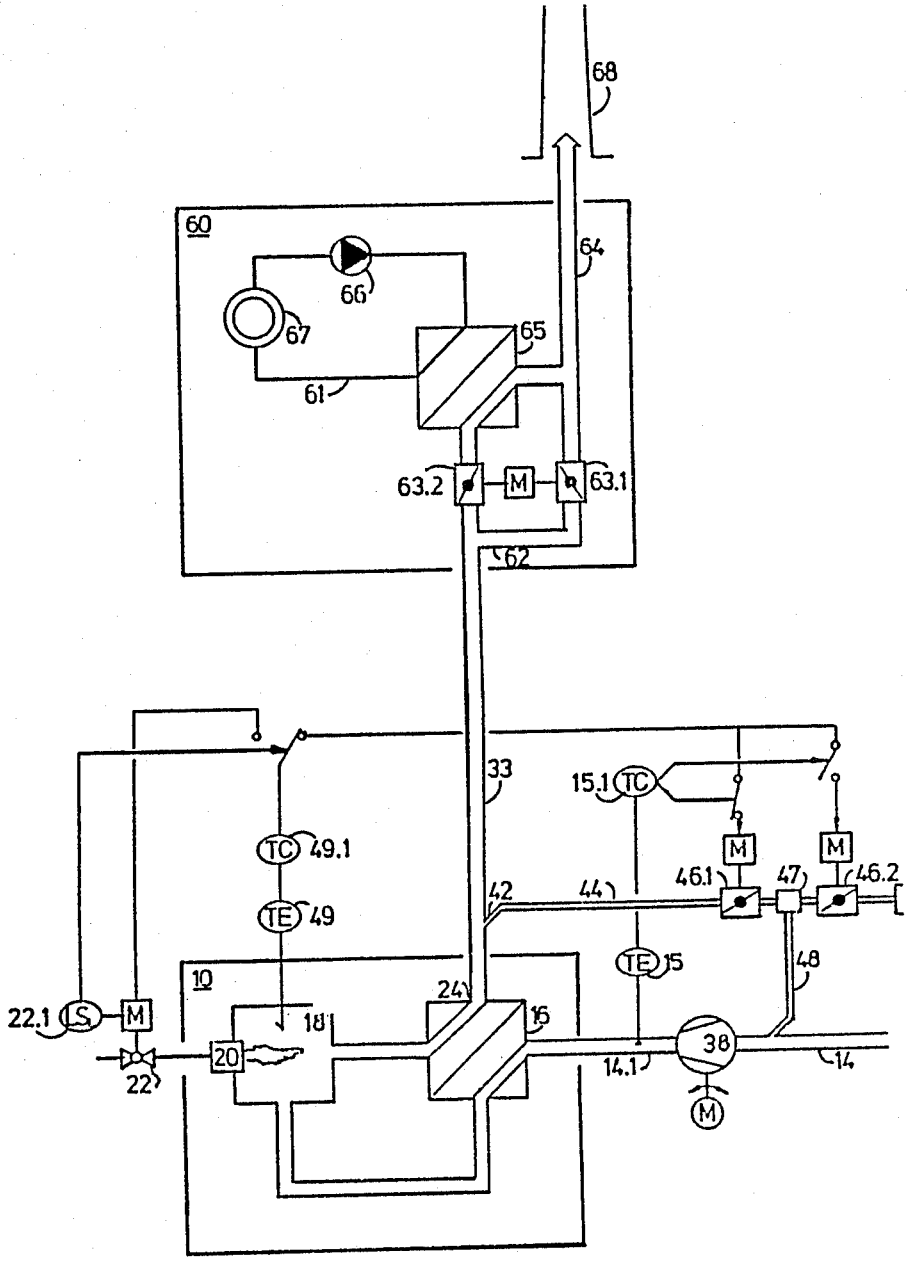
FIG. 2 shows a process sequence pursuant to the invention.

The process for controlled afterburning of oxidisable substances in the process exhaust gas (exhaust air, carrier gas) pursuant to the invention, is set forth in FIG. 2, whereby the elements which correspond to those in FIG. 1 bear the same reference numbers.

The untreated process gas is fed into the heat exchanger (16) and from there into the combustion chamber (18) via a supply line (14) in which a process exhaust gas fan (38) with volumetric flow control (shown hear as a change in revolution) is fitted. After preheating in the heat exchanger (16), the still untreated process gas is fed into the immediate vicinity of the burner (20) from whence it reaches the actual main combustion chamber (18) via a high velocity pipe which is not depicted here. The burner (20) is supplied with the quantity of fuel required at any given moment by means of a control valve. The purified gas is then fed from the combustion chamber (18), via the hot gas side of the heat exchanger (16), to the outlet (24). Should the concentration of untreated exhaust gases exceed the control capacity of the burner, then, pursuant to the invention, it is proposed that the concentration be corrected by adding already purified exhaust gas, mixed with fresh air, in order to ensure that only exhaust gas with a constant proportion of oxidisable substances (e.g. solvents) is fed into the appliance (10). This ensures that the burner (20) can be operated at a constant control range minimum (=basic duty). As the specific proportion of substances to be incinerated now remains constant, the constancy of the temperature within the appliance (10) is ensured, whereby the components, in particular the tubes of the heat exchanger (16) are not subjected to any fluctuation in expansion and tension. This increases the service life of the heat exchanger.

As mentioned above, the control function in this process is dependent upon the temperature (actual temperature) registered in the combustion chamber by one thermocouple (49), which is compared to a nominal temperature at a temperature controller (49.1). Depending on the deviation between the actual temperature and the nominal temperature, the fuel supply is then regulated via the valve (22) in such a way that the burner (20) first operates towards its minimum duty.

This is then indicated by a minimum switch (22.1). In order to maintain the temperature in the combustion chamber (18) at its nominal value, the control valves (46.1) and (46.2) are then activated to add fresh air and/or purified process exhaust gas to the untreated process exhaust gas flowing in the duct (14).

The purified exhaust air which has been cooled in the heat exchanger (16) is taken off at the exhaust gas outlet (24)—emphasised by connecting point (42)—and flows from there through the line (44) to the point of unification (47) which can entail mixing properties. The quantity of purified air which is needed or required at any given time is provided by means of a control valve (46.1). The adequate quantity of fresh air flows via the control device or valve (46.2) to the mixing point (47). The partial vacuum in the line (48) causes the suction of both quantities, which are now in the form of a quantity of mixed air. The line (48) opens into the process exhaust air duct (14) in which this partial vacuum or suction pressure can be held constant.

The mixture of process exhaust air and added air is then fed into the heat exchanger (16) by the extraction fan via the line (14.1).

Neither the preheating nor the combustion chamber temperature changes. The burner burns at control range minimum, as the control device described herein takes over responsibility for the complete constancy as soon as the burner reaches control range minimum, and retains this responsibility until the level of combustible substance declines so far that the dosage operation ends and the burner reassumes the control function.

The fact that excess concentration of combustible substances can be reduced to and retained at a specific lower level, and how this can be done, has now been sufficiently demonstrated. An explanation as to how the burner then operates on minimum flame has also been given. In the following, the role of the temperature control, pursuant to the invention. is explained:

Practical experience has shown that, when a higher concentration of combustible substances occurs, the temperature of the process exhaust air also increases. Often, the higher process temperature is a prerequisite for the release of the substances, as is the case, for example, with solvents from inks and paints.

The higher temperature of the process exhaust gas also results in an increase in the preheating temperature. This means that the higher preheating temperature of the air reduces the temperature difference between the constant high incineration temperature in the combustion chamber and the preheating temperature of the air. However, as the burner consumes a certain proportion of this itself, even when it has throttled back to control range minimum, ever lower quantities remain available for the thermal conversion of oxidisable substances in the process exhaust air. This means that the higher the process air temperature rises, the higher the preheating in the heat exchanger becomes and the lower the acceptable concentration of oxidisable substances in the exhaust air (which acts as, and indeed constitutes, a second fuel source).

Pursuant to the invention, the appliance counteracts this behaviour by means of its temperature control:

If a plant reaches its "first capacity limit" through the minimum setting of the burner, then, by means of comparing the nominal value on the temperature controller (15.1) with the actual value measured by the thermocouple (15) downstream from the extraction fan (38), the control decides whether more or less cold air should first be added and at what point warm air should be added simultaneously. In this way, the preheating temperature is also returned to its normal level and the processing capacity for the combustible substance is increased. The entire unit thus returns to the range of its specific parameters.

However, in the less frequent event that the concentration of oxidisable substances is linked to a lower than desirable exhaust air temperature, the control automatically corrects this by raising the exhaust gas temperature by adding mainly hot air. This also prevents the formation of condensate in the annular pipe and in the inlet area of the incineration appliance. In other words, when there is particularly high risk of condensate, as in the case of high concentrations of condensable substances together with low temperatures, the control device described above counteracts the tendency towards condensation.

All operation modes which normally run on cold air run on warm air pursuant to the invention. This means retaining warmth in idling operation and starting up or warming up the unit when it is still cold.

In the former case, this involves an economy operating mode using a very low volumetric flow of warm air. The warm air temperature corresponds precisely to the nominal process gas temperature. The temperature control (15.1) establishes the precise mixture temperature.

All the components of the afterburning appliance retain their usual temperature level as a result of the warm idling operation mode. Start-up operation using warm air allows a more rapid and economic start-up than is the case with cold air. Moreover, the areas between the extraction fan (38) up to the heat exchanger (16) are successively brought up to higher temperatures until the unit's state of readiness for operation has reached a level at which the risk of condensate in the danger zones has been eliminated on switching over to the process onstream status.

The extensive technical testing of the process has shown it to have a range of various properties which were unforeseen and, therefore, a particularly positive surprise. Individually, these are:

(a) Due to the warm idling operation mode, distinctly improved thermodynamic conditions prevail throughout the entire afterburning appliance, even at the lowest of volumetric flows, with the result that the minimum air flow required to activate shutdown operation could be reduced by up to 35%. Correspondingly, the costs of shutdown operation could be reduced. This is complemented by the reduction in costs achieved in general by the warm air operating mode, which is an inherent feature of this type of operation.

(b) The process responds within seconds, which ranks it as at least the equal of the burner control and by far superior to the bypass system. It now also allows the implementation of super-quick thermocouples.

(c) When idling, i.e. in warm standby operation mode, the temperature now remains constant at the outlet of the afterburner appliance. This not only entails the already recognised positive effects for the downstream peripheral equipment (e.g. for warm water heat exchangers) but also: peripheries with so-called "cold surfaces" operated heat exchangers are considerably cooled down when the incinerator is run on cold air and thus reach the condensation zone. In order to avoid this, the heat recovery must not be allowed to go too far. Pursuant to the invention, this is prevented. Heat recovery can be considerably increased without risk. The process as a whole becomes more economical.

(d) Pressure fluctuations caused by successive processes do not affect the quantity of refluxed warm air, as temperature control takes priority.

(e) By eliminating all condensate danger in the inlet area of the afterburning appliance, the risk of fire is basically eliminated.

(f) The latest production techniques today already include "rapid cleaning systems" as in the case of rotation machines in the printing industry. In seconds, and for brief periods, large quantities of solvents are thus introduced into the exhaust gas flow. The concentration of combustible substances then rises sharply and rapidly. The process pursuant to the invention reacts immediately to these peaks and protects the afterburning appliance from over-temperature.

Figure 3:
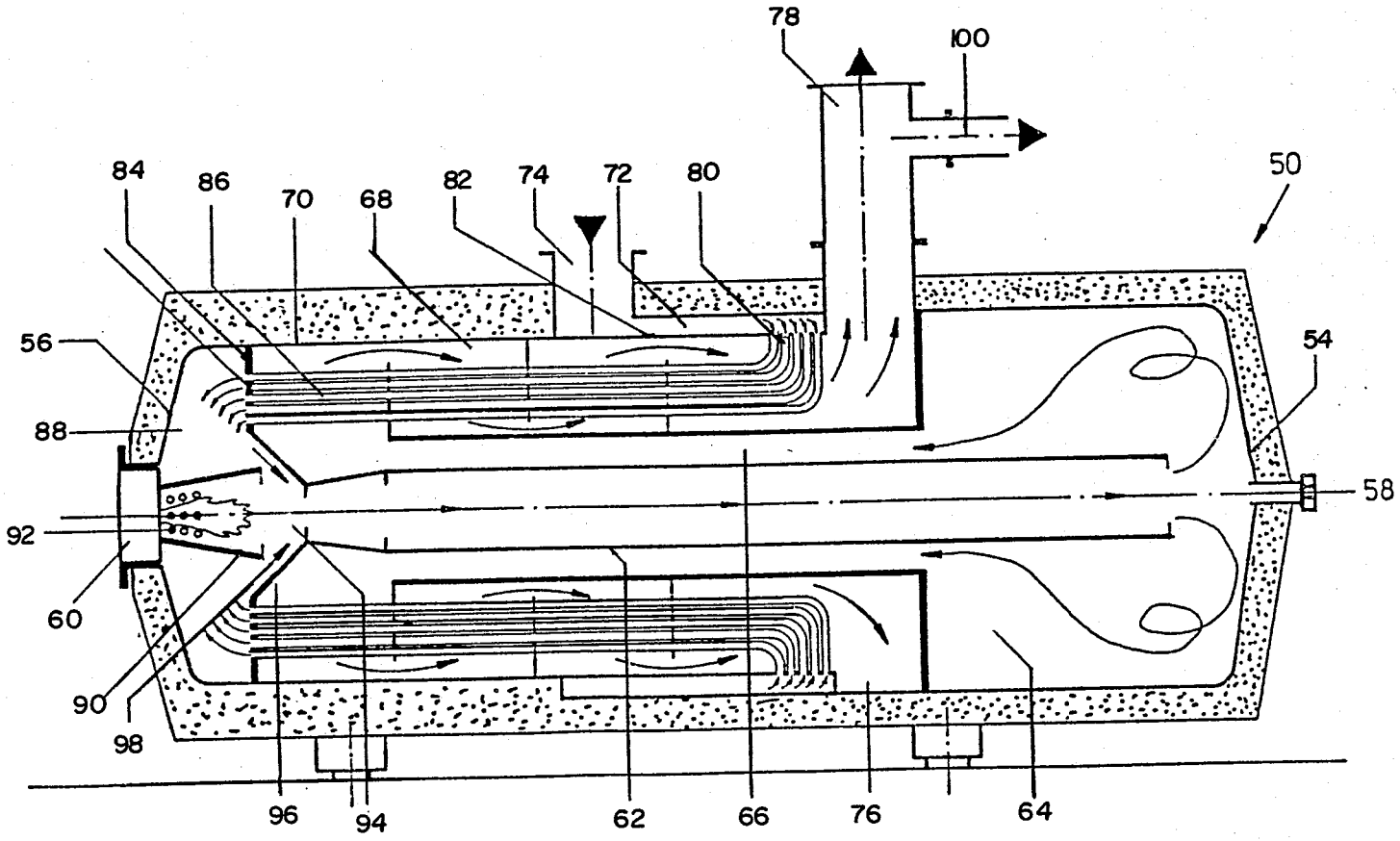
FIG. 3 shows an afterburner appliance putting into practice the process pursuant to the invention.

FIG. 3 shows the principle representation of an afterburning appliance with which the system pursuant to the invention could be realised. The afterburning appliance (50), shown here horizontally, comprises a cylindrical outer shell (52) bounded by closed ends (54) and (56). A burner (60) is located in the area of the closed end (56), concentrically to the main axis (58) of the shell (52) and opens into a high-velocity mixing tube (62) which in turn connects to the main combustion chamber (64) bounded by the outer closed end (54) whereby produces of combustion of the burner (60) are directed into the high-velocity mixing tube (62) generally along a main, or longitudinal, axis (58). However, it is not absolutely necessary for the high-velocity mixing pipe (62) to extend into the main combustion chamber (64) as illustrated in the drawing.

An internal annular chamber (66) runs concentrically to the high-velocity mixing pipe (62) and opens into the chamber (68) in which the heat exchanger tubes (70) are positioned concentrically to the longitudinal axis (58). The actual heat exchanger tubes open into an external annular chamber (72) which is situated outside of the outer wall (52) and which is transitional to the inlet (74). An annular chamber (76) connecting to the outlet (78) is also provided for.

In the vicinity of the outlet (78), the ends (80) of the heat exchanger tubes (70) are bent outwards, i.e. towards the shell (52), so that they open out into the shell (82) of the outer annular chamber (72) in an almost perpendicular position. The other ends (84) of the heat exchanger tubes (70) open into a tube plate (86) which separates a precombustion chamber (88) surrounding the burner (60) from the chamber (68).

The burner (60) is extended by a burner front section (90), which is principally conical in form, circumferencially perforated by holes (92), and has a bell mouth widening in the direction of the high-velocity pipe (62). The high-velocity pipe (62) together with the burner front section (90) forms a "Coanda jet" (in the area of (98) to (94)) at its venturi inlet cone, This is an annulus concentric to the burner which performs part of the work of supplying and removing air to and from the burner.

The connection (100) or the outlet (78) is joined to a mixing device which is not illustrated, but which corresponds to the mixing device (46) which includes the control valves (46.1); (46.2) and flows unification point (47) illustrated in FIG. 2.

The process gas to be incinerated by the appliance pursuant to the invention is fed through the inlet (74) with the annular chamber (72) and conveyed into the main combustion chamber (54) via the heat exchanger tubes (70), the burner front section (90), the "Coanda jet" (96) and the high-velocity tube (62). The purified exhaust gas can then be expelled to the outlet (78) via the annular conduit (66) and the chamber (68) housing the heat exchanger tubes (70).

In order to ensure that the burner (60) can operate at control range minimum (basic duty) even when the quantity of combustible subtances increases, purified gas is conveyed via a connection (100) to the mixing device numbered (46) and (47) in FIG. 2, where more or less fresh air is added in order to achieve a desired mixture temperature. The mixture of warm air thus obtained flows, as in FIG. 2, via the line (48) to the line (14), where it coincides with the increasing or increased concentration of impurities in the untreated process exhaust gas and is mixed in with it to the extent required to maintain a constant concentration of oxidisable substances and to maintain a constant combustion chamber temperature as well as in order to achieve the required or desired temperature prior to the afterburning appliance.

As the concentration is now constant, temperature fluctuations are now virtually eliminated, or only occur to a minor degree, in the individual areas of the plant, particularly in the area of the heat exchanger tubes (70), with the result that large and critical fluctuations in thermal expansion are also eliminated.

All the negative influences resulting from high precombustion levels are also avoided. As the connection (100) from which the purified exhaust gas is taken to be mixed with untreated process gas is not located inside the appliance (10), it is possible, without any extensive design measures, to carry out the mixing as proposed pursuant to the invention in order to maintain the concentration of oxidisable substances at a tolerable level. As a result, the appliance (50) pursuant to the invention is easy to service and ensures a high degree of functional reliability.

The following Tables 1 to 3 are intended to emphasise once again that an afterburning appliance operated in accordance with the invention automatically creates optimum conditions for thermal combustion and, consequently, for the appliance itself.

The thermal afterburning plant discussed here is equipped for a maximum of 15,000 $m_o^3/h$ with a heat exchanger efficiency of 76%. The nominal exhaust gas temperature in the example is 160° C., but in effect, deviates from this. The combustion chamber temperature is to be maintained at a constant 760° C. The plant described is equipped with a special burner which obtains the oxygen it requires for the combustion process from the exhaust gas (secondary air burner: combuster burner). The minimum capacity of the burner (=lower end of the control range) is 67.8 KWh/h.

The plant is supplied from various individual sources. Depending on the source and the number of sources, the volumetric flows vary in size as do the exhaust gas temperatures and, in particular, the quantity and concentration of oxidisable substances in the exhaust gas. The combustible substances are taken to be mineral oils. Three different operating conditions are examined. The results are shown in a table.

TABLE 1

Objective and capacity of the afterburning appliance without excess energy control.

| | Dim'n | Operations 1 | 2 | 3 |
|---|---|---|---|---|
| volumetric flow of exhaust gas V | $m_o^3/h$ | 3,500 | 5,000 | 8,500 |
| oxidisable substances | $g/m_o^3$ | 8 | 7.1 | 3 |
| | KWh/h | 330.6 | 421.6 | 302.4 |
| exhaust gas temperature prior to blower | °C. | 204 | 190 | 160 |
| required temperature $t_1$ in the combustion chamber | °C. | 760 | 760 | 760 |
| preheating temperature $t_1$ would then be | °C. | 628 | 623 | 616 |
| remaining delta t for combustion process | K | 132 | 137 | 144 |
| delta t consumed by burner at minimum flame | K | 45 | 31.5 | 18.5 |
| delta t remaining for incineration of oxidisable | K | 87 | 105.5 | 125.5 |
| free heat capacity at V for incineration of oxidisable substances | KWh/h | 131 | 226.9 | 458.8 |
| excess heat to be removed | KWh/h | 199.6 | 194.6 | none |

Comment:

In operations 1 and 2, there is a considerable excess of heat emanating from oxidisable substances in relation to the above exhaust gas quantity V. This means that, in both these cases, the control function pursuant to the invention intervenes once the burner has reached the lower end of its control range (=minimum control range=basic duty) in a bid to create room for the increasing quantity of oxidisable substances. In both cases, the nominal exhaust gas temperature (here 160° C.) has also been exceeded considerably, with the result that the system intervenes to correct it.

In operation 3, the concentration of oxidisable substances in the exhaust gas is less than the capacity of the unit would allow for this volumetric flow. The burner therefore regulates precisely the quantity of energy lacking by means of its modulating throughput of fuel, without the control pursuant to the invention having to be implemented.

TABLE 2

Execution of task by means of the system pursuant to the invention for operations 1, 2 and 3 as in Table 1.

| | Dim'n | 1 | 2 | 3 |
|---|---|---|---|---|
| warm air recycling via (46.1) | $m_o^3/h$ | 960 | 950 | — |
| cold air added via (46.2) t = 10 CV | $m_o^3/h$ | 1,970 | 1,950 | — |
| new total volumetric flow | $m_o^3/h$ | 6,430 | 7,900 | 8,500 |
| new, corrected exhaust gas temperature | °C. | 160 | 160 | 160 |
| preheating temperature | °C. | 616 | 616 | 616 |
| combustion chamber temperature | °C. | 760 | 760 | 760 |
| fuel consumption | KWh/h | 67.8 | 67.8 | 224.2 |

TABLE 2-continued

Execution of task by means of the system pursuant to the invention for operations 1, 2 and 3 as in Table 1.

| | Dim'n | 1 | 2 | 3 |
|---|---|---|---|---|
| outlet temperature | °C. | 309 | 309 | 310 |
| If the thermal afterburning were carried out by the bypass system known in current technology, then the output temperature in operations 1,2 and 3 would be: | | | | |
| | °C. | 442 | 399 | 310 |

I claim:

1. Process for the controllable thermal afterburning of process exhaust gas containing oxidisable substances, fed through an afterburning appliance in which the process exhaust gas is conveyed via a gas inlet, heat exchanger, burner, combustion chamber and from there, in purified form, via the heat exchanger to a gas outlet, characterised by the process exhaust gas to be fed into the afterburning appliance being mixed with purified process exhaust gas which has been directly mixed with fresh air so as to simultaneously maintain the temperature of gas entering the combustion chamber and the concentration of oxidisable substances in the combustion chamber at a constant value.

2. Process according to claim 1, characterised by the inlet temperature of the gaseous mixture comprised of untreated process exhaust gas, purified process exhaust gas and fresh air which is to be fed into the afterburning being maintained at a constant level.

3. Process according to claim 1, characterised by the burner being operated at control range minimum, (basic duty).

4. Process according to claim 1, characterised by purified process exhaust gas being added to the untreated process exhaust gas after the purified process gas having passed the heat exchanger before mixing.

5. Process for the controllable thermal afterburning of process exhaust gas containing oxidisable substances, fed through an afterburning appliance in which the process exhaust gas is conveyed via a gas inlet, a heat exchanger, a burner, a combustion chamber and from there, in purified form, via the heat exchanger to a gas outlet, characterised by the steps of: feeding the process exhaust gas into the afterburning appliance in indirect heat exchange with purified process exhaust gas by passage through the heat exchanger internally of heat exchanger tubes fitted concentrically to a mixing pipe positioned within the combustion chamber; direction products of combustion of the burner into the mixing pipe generally along a longitudinal axis thereof; and wherein the step of feeding the process exhaust gas into the afterburning appliance is carried forth subsequent to direct admixture of purified process exhaust gas with fresh air so as to simultaneously maintain the temperature of process exhaust gas and the concentration of oxidisable substances entering the combustion chamber at a constant value.

6. The process according to claim 5, characterised by there being, between the appliance (10) and the gas inlet (14, 48), a connection (44) through which purified process exhaust gas may be circulated within the appliance (10).

7. The process according to claim 5, characterized by the heat exchanger tubes being bent outwards at the cold ends and allowing purified process exhaust gas to flow around them.

8. The process according to claim 5, characterised by a duct (14) which conveys the untreated process exhaust gas to the afterburning appliance (10) being fitted with an extraction fan (38), on the suction side of which a partial vacuum may be created through which purified process exhaust gas and fresh air maybe added to the untreated process exhaust gas to the predetermined extent.

9. The process according to claim 8, characterised by the temperature of the purified process exhaust gas and/or fresh air which is to be added to the untreated process exhaust gas being controlled by means of control devices comprising butterfly valves (46.1; 46.2) whose variables are determined by the temperature of the gaseous mixture composed of untreated exhaust gas, purified exhaust gas and/or fresh air indicated at the pressure side of the extraction fan (38).

10. The process according to claim 5, characterised by the control of the concentration of oxidisable substances in the process exhaust gas to be thermally incinerated in the combustion chamber (18) being dependent upon the temperature in the combustion chamber when the burner is operating at control range minimum.

* * * * *